US009458988B2

(12) United States Patent
Caruso et al.

(10) Patent No.: US 9,458,988 B2
(45) Date of Patent: Oct. 4, 2016

(54) COLOR TUNABLE LIGHT EMITTING DEVICE

(71) Applicant: Intematix Corporation, Fremont, CA (US)

(72) Inventors: James Caruso, Albuquerque, NM (US); Charles Edwards, Pleasanton, CA (US)

(73) Assignee: Intematix Corporation, Fremont, CA (US)

( * ) Notice: Subject to any disclaimer, the term of this patent is extended or adjusted under 35 U.S.C. 154(b) by 0 days.

(21) Appl. No.: 14/327,428

(22) Filed: Jul. 9, 2014

(65) Prior Publication Data

US 2015/0077971 A1 Mar. 19, 2015

Related U.S. Application Data

(63) Continuation of application No. 11/906,532, filed on Oct. 1, 2007, now Pat. No. 8,783,887.

(51) Int. Cl.

| | |
|---|---|
| ***F21V 14/08*** | (2006.01) |
| ***F21V 9/10*** | (2006.01) |
| ***F21V 9/16*** | (2006.01) |

(Continued)

(52) U.S. Cl.

CPC . *F21V 9/10* (2013.01); *F21K 9/58* (2013.01); *F21V 9/16* (2013.01); *F21V 14/08* (2013.01); *F21Y 2101/02* (2013.01)

(58) Field of Classification Search

CPC ..... F21V 9/10; F21V 9/16; F21K 9/58

See application file for complete search history.

(56) References Cited

U.S. PATENT DOCUMENTS

| | | | |
|---|---|---|---|
| 2,681,945 | A | 6/1954 | Maurice |
| 2,681,946 | A | 6/1954 | Leverenz |
| 3,290,255 | A | 12/1966 | Smith |

(Continued)

FOREIGN PATENT DOCUMENTS

| | | |
|---|---|---|
| EP | 647694 | 4/1995 |
| GB | 2 017 409 | 10/1979 |

(Continued)

OTHER PUBLICATIONS

Non-Final Office Action dated Mar. 31, 2010 for U.S. Appl. No. 11/906,532.

(Continued)

*Primary Examiner* — Anabel Ton

(74) *Attorney, Agent, or Firm* — Vista IP Law Group, LLP

(57) ABSTRACT

A color/color temperature tunable light emitting device comprises: an excitation source (LED) operable to generate light of a first wavelength range and a wavelength converting component comprising a phosphor material which is operable to convert at least a part of the light into light of a second wavelength range. Light emitted by the device comprises the combined light of the first and second wavelength ranges. The wavelength converting component has a wavelength converting property (phosphor material concentration per unit area) that varies spatially. The color of light generated by the source is tunable by relative movement of the wavelength converting component and excitation source such that the light of the first wavelength range is incident on a different part of the wavelength converting component and the generated light comprises different relative proportions of light of the first and second wavelength ranges.

18 Claims, 10 Drawing Sheets

(51) Int. Cl.

| | |
|---|---|
| ***F21K 99/00*** | (2016.01) |
| *F21Y 101/02* | (2006.01) |

(56) References Cited

U.S. PATENT DOCUMENTS

| | | | |
|---|---|---|---|
| 3,593,055 | A | 7/1971 | Geusic et al. |
| 3,670,193 | A | 6/1972 | Thorington et al. |
| 3,676,668 | A | 7/1972 | Collins et al. |
| 3,691,482 | A | 9/1972 | Pinnow et al. |
| 3,709,685 | A | 1/1973 | Hercock et al. |
| 3,743,833 | A | 7/1973 | Martie et al. |
| 3,763,405 | A | 10/1973 | Mitsuhata |
| 3,793,046 | A | 2/1974 | Wanmaker et al. |
| 3,819,973 | A | 6/1974 | Hosford |
| 3,819,974 | A | 6/1974 | Stevenson et al. |
| 3,849,707 | A | 11/1974 | Braslau et al. |
| 3,875,456 | A | 4/1975 | Kana et al. |
| 3,932,881 | A | 1/1976 | Mita et al. |
| 3,937,998 | A | 2/1976 | Verstegen et al. |
| 3,972,717 | A | 8/1976 | Wiedemann |
| 4,047,075 | A | 9/1977 | Schoberl |
| 4,081,764 | A | 3/1978 | Christmann et al. |
| 4,104,076 | A | 8/1978 | Pons |
| 4,143,394 | A | 3/1979 | Schoberl |
| 4,176,294 | A | 11/1979 | Thornton, Jr. |
| 4,176,299 | A | 11/1979 | Thornton |
| 4,211,955 | A | 7/1980 | Ray |
| 4,305,019 | A | 12/1981 | Graff et al. |
| 4,315,192 | A | 2/1982 | Skwirut et al. |
| 4,443,532 | A | 4/1984 | Joy et al. |
| 4,559,470 | A | 12/1985 | Murakami et al. |
| 4,573,766 | A | 3/1986 | Bournay, Jr. et al. |
| 4,618,555 | A | 10/1986 | Suzuki et al. |
| 4,638,214 | A | 1/1987 | Beers et al. |
| 4,667,036 | A | 5/1987 | Iden et al. |
| 4,678,285 | A | 7/1987 | Ohta et al. |
| 4,682,214 | A | 7/1987 | Sato et al. |
| 4,727,003 | A | 2/1988 | Ohseto et al. |
| 4,772,885 | A | 9/1988 | Uehara et al. |
| 4,792,884 | A | 12/1988 | Suman et al. |
| 4,845,223 | A | 7/1989 | Seybold et al. |
| 4,859,539 | A | 8/1989 | Tomko et al. |
| 4,915,478 | A | 4/1990 | Lenko et al. |
| 4,918,497 | A | 4/1990 | Edmond |
| 4,946,621 | A | 8/1990 | Fouassier et al. |
| 4,992,704 | A | 2/1991 | Stinson |
| 5,003,434 | A | 3/1991 | Gonser et al. |
| 5,077,161 | A | 12/1991 | Law |
| 5,110,931 | A | 5/1992 | Dietz et al. |
| 5,126,214 | A | 6/1992 | Tokailin et al. |
| 5,126,886 | A | 6/1992 | Richardson et al. |
| 5,131,916 | A | 7/1992 | Eichenauer et al. |
| 5,143,433 | A | 9/1992 | Farrell |
| 5,143,438 | A | 9/1992 | Giddens et al. |
| 5,166,761 | A | 11/1992 | Olson et al. |
| 5,208,462 | A | 5/1993 | O'Connor et al. |
| 5,210,051 | A | 5/1993 | Carter, Jr. |
| 5,211,467 | A | 5/1993 | Seder |
| 5,237,182 | A | 8/1993 | Kitagawa et al. |
| 5,241,170 | A | 8/1993 | Field et al. |
| 5,264,034 | A | 11/1993 | Dietz et al. |
| 5,283,425 | A | 2/1994 | Imamura |
| 5,369,289 | A | 11/1994 | Tamaki et al. |
| 5,405,709 | A | 4/1995 | Littman et al. |
| 5,439,971 | A | 8/1995 | Hyche |
| 5,518,808 | A | 5/1996 | Bruno et al. |
| 5,535,230 | A | 7/1996 | Abe |
| 5,549,844 | A | 8/1996 | Bringley et al. |
| 5,557,168 | A | 9/1996 | Nakajima et al. |
| 5,563,621 | A | 10/1996 | Silsby |
| 5,578,839 | A | 11/1996 | Nakamura et al. |
| 5,583,349 | A | 12/1996 | Norman et al. |
| 5,585,640 | A | 12/1996 | Huston et al. |
| 5,619,356 | A | 4/1997 | Kozo et al. |
| 5,660,461 | A | 8/1997 | Ignatius et al. |
| 5,677,417 | A | 10/1997 | Muellen et al. |
| 5,679,152 | A | 10/1997 | Tischler et al. |
| 5,763,901 | A | 6/1998 | Komoto et al. |
| 5,770,887 | A | 6/1998 | Tadatomo et al. |
| 5,771,039 | A | 6/1998 | Ditzik |
| 5,777,350 | A | 7/1998 | Nakamura et al. |
| 5,869,199 | A | 2/1999 | Kido |
| 5,887,965 | A | 3/1999 | Edens et al. |
| 5,952,680 | A | 9/1999 | Strite |
| 5,959,316 | A | 9/1999 | Lowery |
| 5,962,971 | A | 10/1999 | Chen |
| 5,977,694 | A | 11/1999 | McGuire |
| 5,993,037 | A | 11/1999 | Tomioka et al. |
| 6,011,640 | A | 1/2000 | Hutton |
| 6,137,217 | A | 10/2000 | Pappalardo et al. |
| 6,340,824 | B1 | 1/2002 | Komoto et al. |
| 6,381,072 | B1 | 4/2002 | Burger |
| 6,444,988 | B1 | 9/2002 | Vizard |
| 6,504,301 | B1 | 1/2003 | Lowery |
| 6,576,488 | B2 | 6/2003 | Collins et al. |
| 6,600,175 | B1 | 7/2003 | Baretz et al. |
| 6,642,618 | B2 | 11/2003 | Yagi et al. |
| 6,642,652 | B2 | 11/2003 | Collins et al. |
| 6,683,674 | B2 | 1/2004 | Mori et al. |
| 6,686,691 | B1 | 2/2004 | Mueller et al. |
| 6,869,812 | B1 | 3/2005 | Liu |
| 7,014,336 | B1 | 3/2006 | Ducharme et al. |
| 7,027,238 | B2 | 4/2006 | Weiss |
| 7,153,015 | B2 | 12/2006 | Brukilacchio |
| 7,218,429 | B2 | 5/2007 | Batchko |
| 7,233,450 | B2 | 6/2007 | Kao et al. |
| 7,265,338 | B2 | 9/2007 | Kiriyama et al. |
| 7,390,437 | B2 | 6/2008 | Dong et al. |
| 7,462,815 | B2 | 12/2008 | Chua et al. |
| 7,479,662 | B2 | 1/2009 | Soules et al. |
| 7,541,728 | B2 | 6/2009 | Wang et al. |
| 7,615,795 | B2 | 11/2009 | Baretz et al. |
| 7,943,945 | B2 | 5/2011 | Baretz et al. |
| 8,115,779 | B2 | 2/2012 | Ackermann |
| 2001/0009691 | A1 | 7/2001 | Thompson et al. |
| 2002/0090184 | A1 | 7/2002 | Sayag et al. |
| 2003/0042845 | A1 | 3/2003 | Pires et al. |
| 2003/0137844 | A1 | 7/2003 | Bucher et al. |
| 2004/0016938 | A1 | 1/2004 | Baretz et al. |
| 2004/0095767 | A1 | 5/2004 | Ohmae et al. |
| 2004/0257007 | A1 | 12/2004 | Lys et al. |
| 2005/0093430 | A1 | 5/2005 | Ibbetson et al. |
| 2005/0221519 | A1 | 10/2005 | Leung et al. |
| 2006/0027786 | A1 | 2/2006 | Dong et al. |
| 2006/0028122 | A1 | 2/2006 | Wang et al. |
| 2006/0049416 | A1 | 3/2006 | Baretz et al. |
| 2006/0145123 | A1 | 7/2006 | Li et al. |
| 2006/0158090 | A1 | 7/2006 | Wang et al. |
| 2006/0261309 | A1 | 11/2006 | Li et al. |
| 2007/0019408 | A1* | 1/2007 | McGuire, Jr. ..... F21S 10/007 362/231 |
| 2007/0029526 | A1 | 2/2007 | Cheng et al. |
| 2007/0097691 | A1 | 5/2007 | Wu |
| 2007/0132371 | A1 | 6/2007 | Liu |
| 2008/0219303 | A1 | 9/2008 | Chen et al. |
| 2008/0224597 | A1 | 9/2008 | Baretz et al. |
| 2008/0224598 | A1 | 9/2008 | Baretz et al. |
| 2008/0252198 | A1 | 10/2008 | Katano et al. |
| 2009/0034284 | A1 | 2/2009 | Li et al. |
| 2010/0033948 | A1 | 2/2010 | Harbers et al. |
| 2010/0164364 | A1 | 7/2010 | Eida et al. |
| 2010/0315604 | A1 | 12/2010 | Peeters et al. |
| 2011/0116253 | A1 | 5/2011 | Sugiyama |

FOREIGN PATENT DOCUMENTS

| | | |
|---|---|---|
| JP | S50-79379 | 11/1973 |
| JP | 60170194 | 9/1985 |
| JP | 862-189770 | 8/1987 |
| JP | H01-1794 71 | 7/1989 |
| JP | 01-260707 | 10/1989 |
| JP | H02-91980 | 3/1990 |
| JP | H3-24692 | 3/1991 |
| JP | 4010665 | 1/1992 |

(56) References Cited

FOREIGN PATENT DOCUMENTS

| | | |
|---|---|---|
| JP | 4010666 | 1/1992 |
| JP | 04-289691 | 10/1992 |
| JP | 4-321280 | 11/1992 |
| JP | 05-152609 | 6/1993 |
| JP | 6207170 | 7/1994 |
| JP | 6-267301 | 9/1994 |
| JP | 6283755 | 10/1994 |
| JP | 07-099345 | 4/1995 |
| JP | H07-176794 | 7/1995 |
| JP | 07-235207 | 9/1995 |
| JP | H7-282609 | 10/1995 |
| JP | H08-7614 | 1/1996 |
| JP | 8-250281 | 9/1996 |
| JP | 2900928 | 3/1999 |
| JP | P2003-234513 | 8/2003 |
| JP | P3724490 | 9/2005 |
| JP | P3724498 | 9/2005 |
| WO | WO 9108508 | 6/1991 |

OTHER PUBLICATIONS

Final Office Action dated Nov. 12, 2010 for U.S. Appl. No. 11/906,532.
Non-Final Office Action dated Sep. 15, 2011 for U.S. Appl. No. 11/906,532.
Final Office Action dated May 15, 2012 for U.S. Appl. No. 11/906,532.
Notice of Allowance dated Aug. 6, 2012 for U.S. Appl. No. 11/906,532.
Notice of Allowance dated Mar. 10, 2014 for U.S. Appl. No. 11/906,532.
International Search Report and Written Opinion dated Dec. 12, 2008 for Intl. Appln. No. PCT/US08/77977, 11 Pages.
International Search Report and Written Opinion dated Jun. 14, 2012 for Intl. Appln. No. PCT/US12/24032, 8 Pages.
Foreign Office Action dated May 6, 2011 for China Appln. No. 200880114331.0.
Foreign Office Action dated Feb. 13, 2012 for China Appln. No. 200880114331.0.
Foreign Office Action dated Jul. 31, 2012 for China Appln. No. 200880114331.0.
Foreign Office Action dated Jan. 8, 2013 for Japanese Appln. No. 2010-528045.
CRC Handbook, 63rd Ed., (1983) p. E-201.
Lumogen® F Violet 570 Data Sheet; available at the BASF Chemical Company website Lumogen® F Violet 570 Data Sheet; available at the BASF Chemical Company website URL,http://worldaccount.basf.com/wa/EUen_GB/Catalog/Pigments/doc4/BASF/PRD/30048274/.pdt?title=Technicai%20Datasheet&asset_type=pds/pdf&language=EN&urn=urn:documentum:eCommerce_soi_EU :09007bb280021e27.pdf :09007bb280021e27.pdf.
Saleh and Teich, Fundamentals of Photonics, New York: John Wiley & Sons, 1991, pp. 592-594.
The Penguin Dictionary of Electronics, 3rd edition, pp. 315, 437-438, 509-510, copyright 1979, 1988, and 1998.
LEDs and Laser Diodes, Electus Distribution, copyright 2001, available at URL:http://www.jaycar.com.au/images_uploaded/ledlaser.Pdf.
"Fraunhofer-Gesellschafl: Research News Special1997", http://www.fhg.de/press/md-e/md1997/sondert2.hlm, (accessed on Jul. 23, 1998), Jan. 1997, Publisher: Fraunhofer Institute.
Krames, M., et al., "Status and Future of High-Power Light-Emitting Diodes for Solid-Slate Lighting", "Journal of Display Technology", Jun. 2007, pp. 160-175, vol. 3, No. 2.
Kudryashov, V., et al., "Spectra of Superbright Blue and Green InGaN/AlGaN/GaN Light-Emitting diodes", "Journal of the European Ceramic Society", May 1996, pp. 2033-2037, vol. 17.
Lester, S., et al., "High dislocation densities in high efficiency GaN-based light-emitting diodes", "Appl. Phys. Lett.", Mar. 6, 1995, pp. 1249-1251, vol. 66, No. 10.
Mukai, T., et al., "Recent progress of nitride-based light emitting devices", "Phys. Stat. Sol.", Sep. 2003, pp. 52-57, vol. 200, No. 1.
Nakamura, S., et al., "High-power InGaN single-quantum-well-structure blue and violet light-emitting diodes", "Appl. Phys. Lett.", Sep. 25, 1995, pp. 1868-1870, vol. 67, No. 13.
Nakamura, S., et al., "The Blue Laser Diode: GaN Based Light Emitters and Lasers", Mar. 21, 1997, p. 239, Publisher: Springer-Verlag.
Nakamura, S., et al., "The Blue Laser Diode: The Complete Story, 2nd Revised and Enlarged Edition", Oct. 2000, pp. 237-240, Publisher: Springer-Verlag.
Mar. 22, 2012 Office Action in U.S. Appl. No. 12/131,119, issued by Steven Y. Horikoshi.
Pei, Q, et al., "Polymer Light-Emitting Electrochemical Cells", "Science", Aug. 25, 1995, pp. 1086-1088, vol. 269, No. 5227.
Dictionary Definition of Phosphor, Oxford English Dictionary Online, Mar. 9, 2012 (Only partial available due to corrupt file, on Mar. 22, 2012 in U.S. Appl. No. 12/131,119; Request for Full Reference filed).
Feb. 21, 2012 Office Action in U.S. Appl. No. 12/131,118, issued by Abul Kalam.
Jan. 7, 2011 Office Action in U.S. Appl. No. 12/131,119, issued by Steven Y. Horikoshi.
May 4, 2010 Office Action in U.S. Appl. No. 12/131,119.
Jul. 7, 2011 Office Action in U.S. Appl. No. 12/131,118, issued by Abu I Kalam.
Jul. 14, 2011 Office Action in U.S. Appl. No. 12/131,119, issued by Steve Horikoshi.
Aug. 26, 2010 Office Action in U.S. Appl. No. 12/131,118.
Sep. 29, 2009 Office Action in U.S. Appl. No. 11/264,124, issued by Abu I Kalam.
Oct. 20, 2008 Office Action in U.S. Appl. No. 10/623,198, issued by Abu I Kalam.
Nov. 30, 2010 Office Action in U.S. Appl. No. 12/131,118.
Dec. 16, 2004 Office Action in U.S. Appl. No. 10/623,198, issued by Thao X. Le.
Jan. 29, 2007 Office Action in U.S. Appl. No. 10/623,198, issued by Thao X. Le.
Jan. 30, 2006 Office Action in U.S. Appl. No. 11/264,124, issued by Thao X. Le.
Feb. 4, 2005 Office Action in U.S. Appl. No. 10/623,198, issued by Thao X. Le.
Feb. 7, 2007 Office Action in U.S. Appl. No. 11/264,124, issued by Thao X. Le.
Feb. 26, 2008 Office Action in U.S. Appl. No. 11/264,124, issued by Abu I Kalam.
Mar. 2, 2009 Office Action in U.S. Appl. No. 10/623,198, issued by Abu I Kalam.
Mar. 4, 2011 Notice of Allowance, Notice of Allowability, Examiner's Interview Summary, Examiner's Amendment/Comment and Examiner's Statement of Reason for Allowance in U.S. Appl. No. 11/264,124, issued by Abu I Kalam.
Mar. 7, 2008 Office Action in U.S. Appl. No. 10/623,198, issued by Abu I Kalam.
Mar. 28, 2006 Office Action in U.S. Appl. No. 10/623,198, issued by Thao X. Le.
Apr. 15, 2009 Office Action in U.S. Appl. No. 11/264.124, issued by Abu I Kalam.
Jun. 14, 2006 Office Action in U.S. Appl. No. 11/264,124, issued by Thao X. Le.
Jun. 26, 2007 Office Action in U.S. Appl. No. 10/623,198, issued by Thao X. Le.
Jul. 10, 2008 Office Action in U.S. Appl. No. 11/264,124, issued by Abu I Kalam.
Jul. 14, 2005 Notice of Allowance, Notice of Allowability, and Examiner's Statement of Reasons for Allowance in U.S. Appl. No. 10/623,198, issued by Thao X. Le.
Aug. 21, 2006 Office Action in U.S. Appl. No. 10/623,198, issued by Thao X. Le.
Aug. 24, 2007 Office Action in U.S. Appl. No. 11/264,124, issued by Thao X. Le.

(56) References Cited

OTHER PUBLICATIONS

Sep. 17, 2009 Notice of Allowance, Notice of Allowability, Examiner's Amendmeni/Comment, and Examiner's Statement of Reasons for Allowance in U.S. Appl. No. 10/623,198, issued by Abul Kalam.
Amano, H., et al., "UV and blue electroluminescence from Al/GaN:Mg/GaN LED treated with low-energy electron beam irradiation (LEEBI)", "Institute of Physics: Conference Series", 1990, pp. 725-730, vol. 106, No. 10.
Roman. D., "LEDs Turn a Brighter Blue", "Electronic Buyers' News", Jun. 19, 1995, pp. 28 and 35, vol. 960, Publisher: CMP Media LLC.
Bradfield, P.L., et al., "Electroluminescence from sulfur impurities in a p-n junction formed in epitaxial silicon", "Appl. Phys. Lett", 07110/1989, pp. 10D-102D, vol. 55, No. 2.
Das, N.C., et al., "Luminescence spectra of ann-channel metal-oxide-semiconductor field-effect transistor at breakdown", 1990, pp. 1152-1153, vol. 56, No. 12.
Jang, S., "Effect of Avalanche-Induced Light Emission on the Multiplication Factor in Bipolar Junction Transistors", "Solid-State Electronics", 1991, pp. 1191-1196, vol. 34, No. 11.
Pavan, P., et al., "Explanation of Current Crowding Phenomena Induced by Impact Ionization in Advanced Si Bipolar Transistors by Means of . . . ", "Microelectronic Engineering", 1992, pp. 699-702, vol. 19.
Yang, Y., et al., "Voltage controlled two color light-emitting electrochemical cells", "Appl. Phys. Lett.", 1996, vol. 68, No. 19.
Zanoni, E., et al., "Measurements of Avalanche Effects and Light Emission in Advanced Si and SiGe Bipolar Transistors", "Microelectronic Engineering", 1991, pp. 23-26, vol. 15.
Zanoni, E., et al., "Impact ionization, recombination, and visible light emission in ALGaAs/GaAs high electron mobility transistors", "J. Appl. Phys.", 1991, pp. 529-531, vol. 70, No. 1.
Zhiming, Chen, et al., "Amorphous thin film white-LED and its light-emitting mechanism", "Conference Record of the 1991 International Display Research Conference", Oct. 1991, pp. 122-125.
Apr. 14, 2010 Office Action in U.S. Appl. No. 11/264,124.
Adachi, C. et al., "Blue light-emitting organic electroluminescent devices", "Appl. Phys. Lett.", Feb. 26, 1990, pp. 799-801, vol. 56, No. 9.
Akasaki, Isamu, et al., "Photoluminescence of Mg-doped p-type GaN and electroluminescence of GaN p-n junction LED", "Journal of Luminescence", Jan.-Feb. 1991, pp. 666-670, vol. 48-49 pt. 2.
Armaroli, N. et al., "Supramolecular Photochemistry and Photophysics.", "J. Am. Chern. Soc.", 1994, pp. 5211-5217, vol. 116.
Berggren, M., et al., "White light from an electroluminescent diode made from poly[3(4-octylphenyl)-2,2'-bithiophene] and an oxadiazole . . . ", "Journal of Applied Physics", Dec. 1994, pp. 7530-7534, vol. 76, No. 11.
Berggren, M. et al., "Light-emitting diodes with variable colours from polymer blends", "Nature", Dec. 1, 1994, pp. 444-446, vol. 372.
Boonkosum, W. et al., "Novel Flat Panel display made of amorphous SiN:H/SiC:H thin film LED", "Physical Concepts and Materials for Novel Optoelectronic Device Applications II", 1993, pp. 40-51, vol. 1985.
Chao, Zhang Jin, et al., "White light emitting glasses", "Journal of Solid State Chemistry", 1991, pp. 17-29, vol. 93.
Comrie, M. , "Full Color LED Added to Lumex's Lineup", "EBN", Jun. 19, 1995, p. 28.
Zdanowski, Marek, "Pulse operating up-converting phosphor LED", "Electron Technol.", 1978, pp. 49-61, vol. 11, No. 3.
Forrest, S. et al. , "Organic emitters promise a new generation of displays", "Laser Focus World", Feb. 1995, pp. 99-107.
Hamada, Y. et al. , "Blue-Light-Emitting Organic Electroluminescent Devices with Oxadiazole Dimer Dyes as an Emitter", "Jpn. J. Appl. Physics", Jun. 1992, pp. 1812-1816, vol. 31.
Hamakawa, Yoshihiro, et al., "Toward a visible light display by amorphous SiC:H alloy system", "Optoelectronics—Devices and Technologies", Dec. 1989, pp. 281-294, vol. 4, No. 2.
Hirano, Masao, et al., "Various performances of fiber-optical temperature sensor utilizing infrared-to-visible conversion phosphor", "Electrochemisty (JP)", Feb. 1987, pp. 158-164, vol. 55, No. 2, Publisher: Electrochemical Society of Japan.
El Jouhari, N., et al., "White light generation using fluorescent glasses activated by Ce3+, Tb3+ and Mn2+ ions", "Journal De Physique IV, Colloque C2", Oct. 1992, pp. 257-260, vol. 2.
Kido, J. et al. , "1,2,4-Triazole Derivative as an Electron Transport Layer in Organic Luminescent Devices", "Jpn. J. Appl. Phys.", Jul. 1, 1993, pp. L917-L920, vol. 32.
Kido, J., et al., "White light-emitting organic electroluminescent devices using the poly(N-vinylcarbazole) emitter layer doped with . . . ", "Appl. Phys. Lett.", Feb. 14, 1994, pp. 815-817, vol. 64, No. 7.
Kido, J. et al. , "Bright blue electroluminescence from poly(N-vinylcarbazole)", "Appl. Phys. Letters", Nov. 8, 1993, pp. 2627-2629, vol. 63, No. 19.
Larach, S., et al., "Blue emitting luminescent phosphors: Review and status", "Int'l Workshop on Electroluminescence", 1990, pp. 137-143.
Maruska, H.P., et al., "Violet luminescence of Mg-doped GaN", "Appl. Phys. Lett.", Mar. 15, 1973, pp. 303-305, vol. 22, No. 6.
Maruska, H.P., "Gallium nitride light-emitting diodes (dissertation)", "Dissertation Submitted to Stanford University", Nov. 1973.
McGraw-Hill, "McGraw-Hill Dictionary of Scientific and Technical Terms, Third Edition", "McGraw-Hill Dictionary of Scientific and Technical Terms", 1984, pp. 912 and 1446, Publisher: McGraw-Hill.
McGraw-Hill, "McGraw-Hill Encyclopedia of Science and Technology, Sixth Edition", "McGraw-Hill Encyclopedia of Science and Technology", 1987, pp. 582 and 60-63, vol. 9-10, Publisher: McGraw-Hill.
Mimura, Hidenori, et al., "Visible electroluminescence from uc-SiC/porous Si/c-Si p-n junctions", "Int. J. Optoelectron.", 1994, pp. 211-215, vol. 9, No. 2.
Miura, Noboru, et al., "Several Blue-Emitting Thin-Film Electroluminescent Devices", "Jpn. J. Appl. Phys.", Jan. 15, 1992, pp. L46-L48, vol. 31, No. Part 2, No. 1A IB.
Muench, W.V., et al., "Silicon carbide light-emitting diodes with epitaxial junctions", "Solid-State Electronics", Oct. 1976, pp. 871-874, vol. 19, No. 10.
Pankove, J.I., et al., "Scanning electron microscopy studies of GaN", "Journal of Applied Physics", Apr. 1975, pp. 1647-1652, vol. 46, No. 4.
Sato, Yuichi, et al., "Full-color fluorescent display devices using a near-UV light-emitting diode", "Japanese Journal of Applied Physics", Jul. 1996, pp. L838-L839, vol. 35, No. ?A.
Tanaka, Shosaku, et al., "Bright white-light electroluminescence based on nonradiative energy transfer in Ce-and Eu-doped SrS thin films", "Applied Physics Letters", Nov. 23, 1987, pp. 1661-1663, vol. 51, No. 21.
Tanaka, Shosaku, et al., "White Light Emitting Thin-Film Electroluminescent Devices with SrS:Ce,Cl/ZnS:Mn Double Phosphor Layers", "Jpn. J. Appl. Phys.", Mar. 20, 1986, pp. L225-L227, vol. 25, No. 3.
Ura, M. , "Recent trends of development of silicon monocarbide blue-light emission diodes", "Kinzoku", 1989, pp. 11-15, vol. 59, No. 9.
Werner, K. , "Higher Visibility for LEDs", "IEEE Spectrum", Jul. 1994, pp. 30-39.
Wojciechowski, J. et al. , "Infrared-To-Blue Up-Converting Phosphor", "Electron Technology", 1978, pp. 31-47, vol. 11, No. 3.
Yamaguchi, Y. et al., "High-Brightness SiC Blue LEDs and Their Application to Full Color LED Lamps", "Optoelectronics-Devices and Technologies", Jun. 1992, pp. 57-67, vol. 7, No. 1.
Yoshimi, Masashi, et al., "Amorphous carbon basis blue light electroluminescent device", "Optoelectronics—Devices and Technologies", Jun. 1992, pp. 69-81, vol. 7, No. 1.

(56) References Cited

OTHER PUBLICATIONS

Morkoc et al., "Large-band-gap SIC, 111-V nitride, and II-VI ZnSe-based semiconductor device technologies", J. Appl. Phys. 76(3), 1; Mar. 17, 1994; Illinois University.
Reexam Non-Final Office Action dated Sep. 20, 2010 for U.S. Appl. No. 90/010,940.
Reexam Non-Final Office Action dated Mar. 3, 2011 for U.S. Appl. No. 90/010,940.
Reexam Final Office Action dated Nov. 7, 2011 for U.S. Appl. No. 90/010,940.
Reexam Non-Final Office Action dated Jan. 26, 2012 for U.S. Appl. No. 90/010,940.
Reexam Final Office Action dated May 24, 2012 for U.S. Appl. No. 90/010,940.
Reexam Advisory Action dated Sep. 28, 2012 for U.S. Appl. No. 90/010,940.
Foreign Office Action dated Aug. 28, 2013 for Taiwanese Appln. No. 97137791.
Non-Final Office Action dated Jun. 12, 2014 for U.S. Appl. No. 13/367,325.
Foreign Office Action dated Jan. 30, 2015 for Korean Appln. No. 10-2010-7009589.

* cited by examiner

COLOR TUNABLE LIGHT EMITTING DEVICE

CROSS-REFERENCE TO RELATED APPLICATION(S)

This application is a continuation of U.S. patent application Ser. No. 11/906,532, filed on Oct. 1, 2007, entitled "COLOR TUNABLE LIGHT EMITTING DEVICE", which is hereby incorporated by reference in its entirety.

BACKGROUND OF THE INVENTION

1. Field of the Invention

This invention relates to color/color temperature tunable light emitting devices and in particular to solid state light sources, such as light emitting diodes, which include a wavelength converting phosphor material to generate a specific color of light.

2. Description of the Related Art

The color of light generated by a light source, in particular light emitting diodes (LEDs), is determined predominantly by the device architecture and materials selection used to generate the light. For example, many LEDs incorporate one or more phosphor materials, which are photo-luminescent materials, which absorb a portion of the radiation emitted by the LED chip/die and re-emit radiation of a different color (wavelength). This is the state of the art in the production of "white" LED light sources. The net color of light generated by such LEDs is the combined native color (wavelength) of light from the LED chip and color re-emitted by the phosphor which is fixed and determined when the LED light is fabricated.

Color switchable light sources are known which comprise red, green and blue LEDs. The color of light output from such a source can be controlled by selective activation of one or more of the different colored LEDs. For example, activation of the blue and red LEDs will generate light which appears purple in color and activation of all three LEDs produces light which appears white in color. A disadvantage of such light sources is the complexity of driver circuitry required to operate these sources.

U.S. Pat. No. 7,014,336 discloses systems and methods of generating colored light. One lighting fixture comprises an array of component illumination sources (different color LEDs) and a processor for controlling the collection of component illumination sources. The processor controls the intensity of the different color LEDs in the array to produce illumination of a selected color within a range bounded by the spectra of the individual LEDs and any filters or other spectrum-altering devices associated with the lighting fixture.

White LEDs are known in the art and are a relatively recent innovation. It was not until LEDs emitting in the blue/ultraviolet part of the electromagnetic spectrum were developed that it became practical to develop white light sources based on LEDs. As taught for example in U.S. Pat. No. 5,998,925, white light generating LEDs ("white LEDs") include one or more phosphor materials, that is photo-luminescent materials, which absorb a portion of the radiation emitted by the LED and re-emit radiation of a different color (wavelength). Typically, the LED chip or die generates blue light and the phosphor(s) absorb a percentage of the blue light and re-emits yellow light or a combination of green and red light, green and yellow light or yellow and red light. The portion of the blue light generated by the LED that is not absorbed by the phosphor is combined with the light emitted by the phosphor and provides light which appears to the human eye as being nearly white in color.

As is known, the correlated color temperature (CCT) of a white light source is determined by comparing its hue with a theoretical, heated black-body radiator. CCT is specified in Kelvin (K) and corresponds to the temperature of the black-body radiator which radiates the same hue of white light as the light source. The CCT of a white LED is generally determined by the phosphor composition and the quantity of phosphor incorporated in the LED.

White LEDs are often fabricated by mounting the LED chip in a metallic or ceramic cup using an adhesive and then bonding lead wires to the chip. The cup will often have a reflecting inner surface to reflect light out of the device. The phosphor material, which is in powder form, is typically mixed with a silicone binder and the phosphor mixture is then placed on top of the LED chip. A problem in fabricating white LEDs is variation of CCT and color hue between LEDs that are supposed to be nominally the same. This problem is compounded by the fact that the human eye is extremely sensitive to subtle changes in color hue especially in the "white" color range. A further problem with white LEDs is that their CCT can change over the operating lifetime of the device and such color change is particularly noticeable in lighting sources that comprise a plurality of white LEDs such as LED lighting bars.

To alleviate the problem of color variation in LEDs with phosphor wavelength conversion as is described above, in particular white LEDs, LEDs are categorized post-production using a system of "bin out" or "binning." In binning, each LED is operated and the actual color of its emitted light measured. The LED is then categorized, or binned according to the actual color of light the device generates, not based on the target CCT with which it was produced. Typically, nine or more bins (regions of color space or color bins) are used to categorize white LEDs. A disadvantage of binning is increased production costs and a low yield rate as often only two out of the nine bins are acceptable for an intended application resulting in supply chain challenges for white LED suppliers and customers.

It is predicted that white LEDs could potentially replace incandescent, fluorescent and neon light sources due to their long operating lifetimes, potentially many hundreds of thousands of hours, and their high efficiency in terms of low power consumption. Recently high brightness white LEDs have been used to replace conventional white fluorescent, mercury vapor lamps and neon lights. Like other lighting sources, the CCT of a white LED is fixed and is determined by the phosphor composition used to fabricate the LED.

U.S. Pat. No. 7,014,336 discloses systems and methods of generating high-quality white light, which is white light having a substantially continuous spectrum within the photopic response (spectral transfer function) of the human eye. Since the eye's photopic response gives a measure of the limits of what the eye can see this sets boundaries on high-quality white light having a wavelength range 400 nm (ultraviolet) to 700 nm (infrared). One system for creating white light comprises three hundred LEDs each of which has a narrow spectral width and a maximum spectral peak spanning a predetermined portion of the 400 to 700 nm wavelength range. By selectively controlling the intensity of each of the LEDs the color temperature (and also color) can be controlled. A further lighting fixture comprises nine LEDs having a spectral width of 25 nm spaced every 25 nm over the wavelength range. The powers of the LEDs can be adjusted to generate a range of color temperatures (and colors as well) by adjusting the relative intensities of the nine LEDs. It is also proposed to use fewer LEDs to generate white light, provided each LED has an increased spectral width to maintain a substantially continuous spectrum that fills the photopic response of the eye. Another lighting fixture comprises using one or more white LEDs and providing an optical high-pass filter to change the color temperature of the white light. By providing a series of interchangeable filters this enables a single light fixture to produce white light of any temperature by specifying a series of ranges for the various filters. Whilst such systems can produce high-quality white light such fixtures are too expensive for many applications due to the complexity of fabricating a plurality of discrete single color LEDs and due to the control circuitry required for operating them.

A need exists therefore for a color tunable light source that overcomes the limitations of the known sources and in particular an inexpensive solid state light source such as an LED which includes a wavelength converting phosphor material, whose color and/or CCT of light emission is at least in part tunable.

SUMMARY OF THE INVENTION

The present invention arose in an endeavor to provide a light emitting device whose color is at least in part tunable. Moreover, the present invention, at least in part, addresses the problem of color hue variation of LEDs that include phosphor wavelength conversion and attempts to reduce or even eliminate the need for binning. A further object of the invention is to provide an inexpensive color tunable light source compared with multi-colored LED packages.

According to the invention there is provided a color tunable light emitting device comprising: an excitation source, such as a LED, that is operable to generate light of a first wavelength range and a wavelength converting component comprising at least one phosphor material which is operable to convert at least a part of the light into light of a second wavelength range, wherein light emitted by the device comprises the combined light of the first and second wavelength ranges, wherein the wavelength converting component has a wavelength converting property that varies spatially and wherein color of light generated by the source is tunable by a relative movement of the wavelength converting component and excitation source such that the light of the first wavelength range is incident on a different part of the wavelength converting component. A particular advantage of the light emitting device of the invention is that since its color temperature can be accurately set post-production this eliminates the need for expensive binning. As well as the manufacturer or installer setting the color/color temperature a user can periodically adjust the color/color temperature throughout the lifetime of the device or more frequently for "mood" lighting.

The wavelength converting component can be moveable relative to the excitation source and can have a wavelength converting property that varies: along a single dimension, along two dimensions or rotationally. The wavelength converting properties of the component can be configured to vary by a spatial variation in a concentration (density) per unit area of the phosphor material. Such a variation can comprise a spatial variation in thickness of the at least one phosphor material such as a thickness that varies substantially linearly. In one arrangement, the at least one phosphor is incorporated in a transparent material, such as an acrylic or silicone material, with a concentration of phosphor material per unit volume of transparent material that is substantially constant and the thickness of the wavelength converting component varies spatially. An example of one such component is wedge-shaped and has a thickness that tapers along the length of the component. In an alternative arrangement the wavelength converting component comprises a transparent carrier on a surface of which the phosphor material is provided. In a preferred implementation, the phosphor material is provided as a spatially varying pattern, such as for example a pattern of dots or lines of varying size and/or spacing, such that the concentration per unit area of the at least one phosphor material varies spatially. In such an arrangement the thickness and concentration of the phosphor material can be substantially constant. The phosphor material can be deposited on the carrier using a dispenser to selectively dispense the phosphor material or printed using screen printing.

The wavelength converting component can further comprise a second phosphor material which is operable to convert at least a part of the light of the first wavelength range into light of a third wavelength range, such that light emitted by the device comprises the combined light of the first, second and third wavelength ranges and a concentration per unit area of the second phosphor material varied spatially.

The light emitting device can further comprise a second wavelength converting component comprising a second phosphor material which is operable to convert at least a part of the light of the first wavelength range into light of a third wavelength range, wherein light emitted by the device comprises the combined light of the first, second and third wavelength ranges wherein the second wavelength converting component has a wavelength converting property that varies spatially and wherein color of light generated by the source is tunable by moving the first and second wavelength converting components relative to the excitation source such that the light of the first wavelength range is incident on different parts of the first and second wavelength converting components. Preferably, the first and second wavelength converting components are independently moveable with respect to one another and to the excitation source. Such an arrangement enables color tuning over an area of color space.

As in the first wavelength converting component the concentration of the second phosphor per unit area can vary spatially with, for example, a variation in phosphor thickness or a variation in a pattern of phosphor material.

In a further embodiment of the invention there is provided a color tunable light emitting device comprising: a plurality of light emitting diodes operable to generate light of a first wavelength and a wavelength converting component which is operable to convert at least a part of the excitation radiation into light of a second wavelength, wherein light emitted by the device comprises the combined light of the first and second wavelength ranges and wherein the wavelength converting component comprises a plurality of wavelength converting regions comprising at least one phosphor material in which a respective region is associated with a respective one of the light emitting diode and wherein each region has a wavelength converting property that varies spatially and wherein color of light generated by the device is tunable by moving the component relative to the light emitting diodes such that the light of the first wavelength range from each light emitting diode is incident on a different part of its respective wavelength converting region.

In one arrangement the plurality of light emitting diodes comprises a linear array and the wavelength converting regions comprise a corresponding linear array and the source is tunable by linearly displacing the component relative to the array of light emitting diodes. Alternatively, the plurality of light emitting diodes comprise a two dimensional array and the wavelength converting regions comprise a corresponding two dimensional array and wherein the source is tunable by displacing the component relative to the array of light emitting diodes along two dimensions.

In a yet further arrangement, the plurality of light emitting diodes comprise a circular array and the wavelength converting regions comprise a corresponding circular array and the device is tunable by rotationally displacing the component relative to array of light emitting diodes.

BRIEF DESCRIPTION OF THE DRAWINGS

In order that the present invention is better understood embodiments of the invention will now be described, by way of example only, with reference to the accompanying drawings in which.

DETAILED DESCRIPTION OF THE INVENTION

Embodiments of the invention are based on a wavelength converting component that has a wavelength converting property (characteristic) that varies spatially and which is used to convert light from an excitation source, typically a light emitting diode (LED), which is of one wavelength range (color) into light of a different wavelength range (color). The color of light generated by the device, which comprises the combined light of the first and second wavelength ranges, can be controlled (tuned) by moving the component relative to the excitation source to change the total proportion of light of the second wavelength range.

Figure 1A:
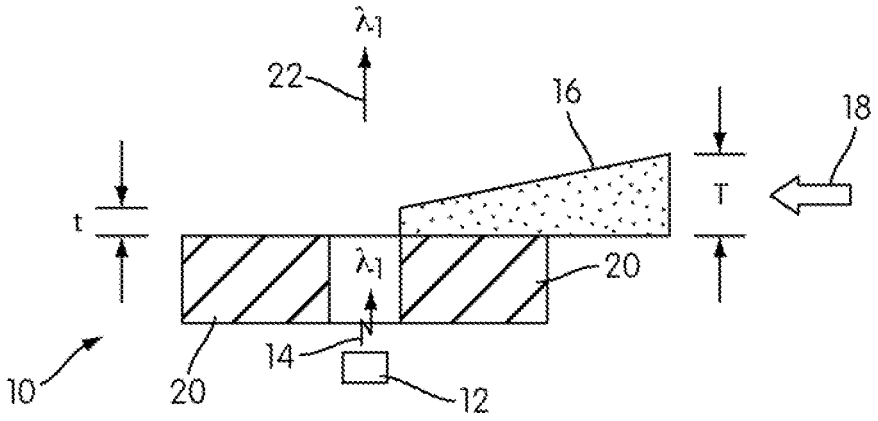
FIGS. 1(*a*) to (*c*) are schematic representations of the principle of operation of a color tunable light emitting device in accordance with the invention.
Figure 1B:
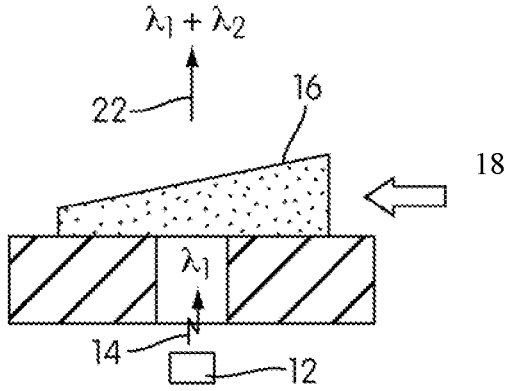
Figure 1C:
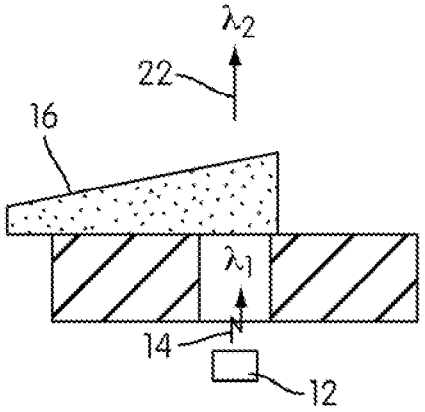

Referring to FIGS. 1(*a*) to (*c*) there are shown schematic representations of the principle of operation of a color tunable light emitting device 10 in accordance with the invention. The device 10 comprises an excitation source 12 operable to generate excitation radiation 14 (light) of wavelength range $\lambda_1$ and a moveable wavelength converting component 16. Typically, the excitation source 12 comprises a light emitting diode (LED) such as an InGaN/GaN (indium gallium nitride/gallium nitride) based LED chip which is operable to generate blue light of wavelength 400 to 465 nm.

In the example embodiment illustrated, the wavelength converting component 16 is tapered in form (wedge-shaped) and tapers in thickness between thicknesses t and T along its direction 18 of intended movement. The wavelength conversion component 16 can be fabricated from a transparent substrate material, for example an acrylic or silicone material such as GE's RTV615, which incorporates a phosphor (photo luminescent or wavelength converting) material. As is known, phosphor materials absorb excitation radiation (light) of a first wavelength and re-emit light of a longer wavelength $\lambda_2$, for example green in color. The phosphor material, which is in powder form, is substantially uniformly distributed throughout the acrylic material and has a weight ratio loading of phosphor to acrylic in a typical range 5 to 50% depending on the intended color range of operation of the light device 10. Since the phosphor material is uniformly distributed throughout the component, that is the concentration of phosphor per unit volume of substrate material is substantially constant, and the component varies in thickness along its length, the quantity of phosphor per unit area (grams per square meter—$g/m^2$) varies in a linear manner along the length of the component. In other words the wavelength converting component 16 has a wavelength converting property (characteristic) that varies along its length.

As represented in FIG. 1, a light blocking element 20 is provided to confine the area of incidence of the excitation radiation (blue light) 14 to a small portion of the wavelength converting component 16. In preferred implementations, the LED chip 12 is packaged in a ceramic or metallic housing and the wavelength converting component mounted in close proximity, or even in sliding contact with, the housing opening. In such an arrangement the housing walls function as the light blocking element. To optimize the overall efficiency of the device, the inner surface of the housing walls 20 are preferably highly reflective.

Figure 2:
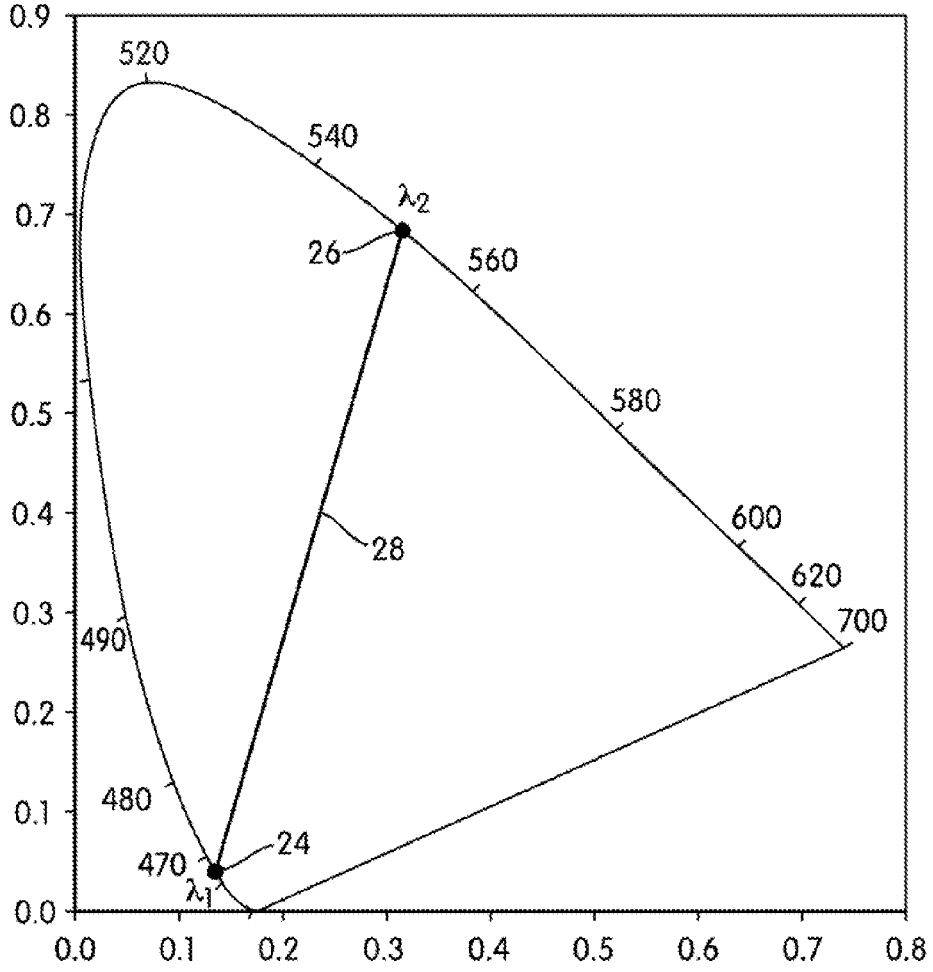
FIG. 2 is a CIE (Commission Internationale de l'Eclairage) 1931 chromaticity diagram illustrating color tuning for the device of FIG. 1.
Figure 3A:
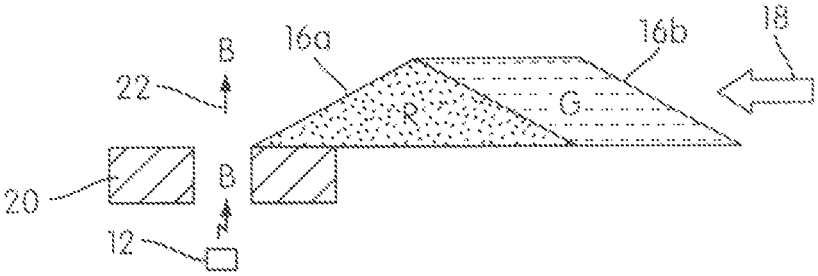
FIGS. 3(*a*) to (*f*) are schematic representations of the operation of a color tunable light emitting device in accordance with a further embodiment of the invention.
Figure 3B:
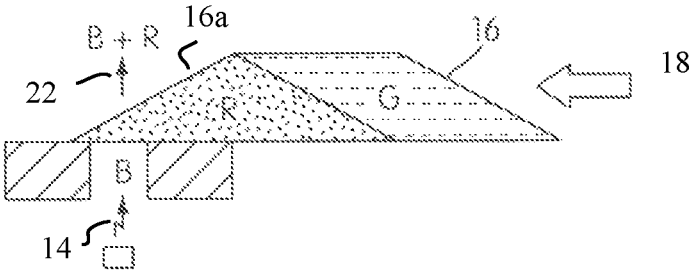
Figure 3C:
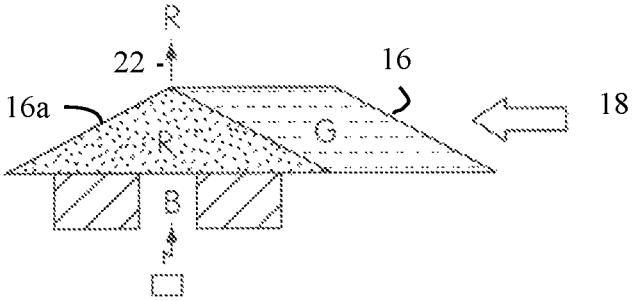
Figure 3D:
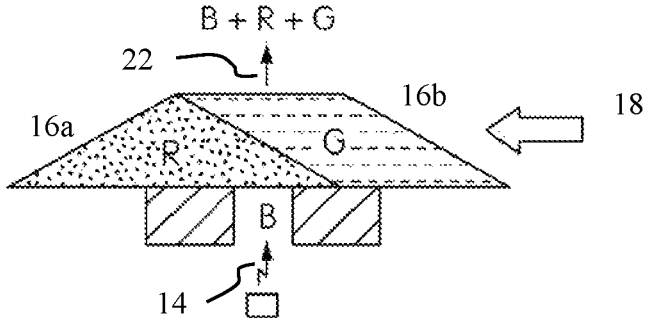
Figure 3E:
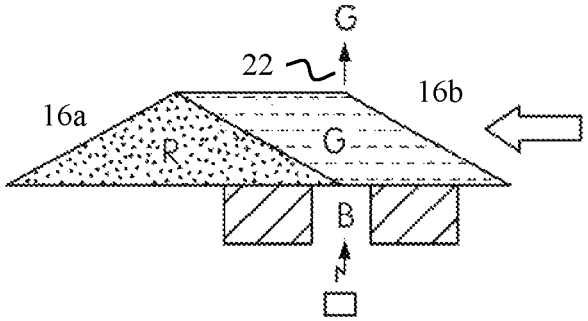
Figure 3F:
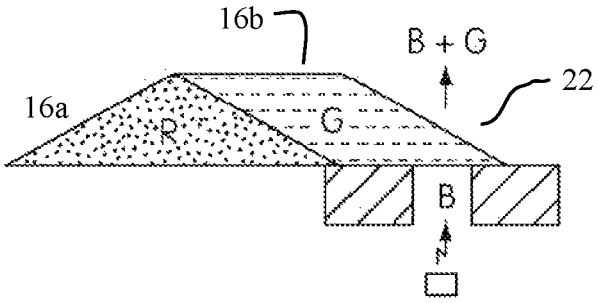

Operation of the device 10 will now be described by way of reference to FIGS. 1(*a*) to (*c*) and FIG. 2 which is a CIE (Commission Internationale de l'Eclairage) 1931 chromaticity diagram illustrating color tuning of the device. In FIG. 1(*a*) the wavelength converting component is shown in a fully retracted position such that light 22 generated by the device 10 comprises light 14 from the LED chip only. Consequently light generated by the device is of wavelength $\lambda_1$, which is blue in color, and corresponds to point 24 in FIG. 2.

In FIG. 1(*b*) the wavelength converting component 16 has been translated in a direction 18 such that light 14 from the LED is now incident on a region of the component. The phosphor material within the component absorbs a part of the excitation radiation (light) 14 and re-emits light of wavelength $\lambda_2$ that is green in color in this example in which a blue activated green emitting phosphor material is incorporated in the wavelength converting component 16. Now, the light 22 generated by the device comprises a combination of blue ($\lambda_1$) and green ($\lambda_2$) light and will appear turquoise in color. The proportion of green ($\lambda_2$) light in the output light depends on the concentration of phosphor per unit area ($g/m^2$) which will depend on the position of the component relative to the LED. For a given location, and a given thickness of the component 16, such resultant light will have a color dependant on the phosphor unit area loading at that location. This resulting color will be consistent with a point on line 28 of the CIE diagram in FIG. 2, the exact position of which depends on the choice of phosphor and loading of such phosphor in the wavelength converting component 16.

In FIG. 1(*c*) the wavelength converting component 16 has been further translated such that the thickest part T of the component is now positioned over the LED chip. The concentration of phosphor within the component and the thickness T are configured such the phosphor now absorbs all light from the LED and re-emits green light. Thus the light 22 generated by device now comprises green ($\lambda_2$) light generated by the phosphor only and this is indicated as point 26 on the chromaticity diagram of FIG. 2. It will be appreciated that the color of light emitted by the device is tunable between the points 24 and 26 along a line 28 and depends on the position of the wavelength selective component.

It is intended that light emitting devices in accordance with the invention use inorganic phosphor materials such as for example silicate-based phosphor of a general composition $A_3Si(OD)_5$ or $A_2Si(OD)_4$ in which Si is silicon, O is oxygen, A comprises strontium (Sr), barium (Ba), magnesium (Mg) or calcium (Ca) and D comprises chlorine (Cl), fluorine (F), nitrogen (N) or sulfur (S). Examples of silicate-based phosphors are disclosed in our co-pending patent applications US2006/0145123, US2006/028122, US2006/261309 and US2007029526 the content of each of which is hereby incorporated by way of reference thereto.

As taught in US2006/0145123, a europium ($Eu^{2+}$) activated silicate-based green phosphor has the general formula $(Sr,A_1)_x(Si,A_2)(O,A_3)_{2+x}:Eu^{2+}$ in which: $A_1$ is at least one of a 2+ cation, a combination of 1+ and 3+ cations such as for example Mg, Ca, Ba, zinc (Zn), sodium (Na), lithium (Li), bismuth (Bi), yttrium (Y) or cerium (Ce); $A_2$ is a 3+, 4+ or 5+ cation such as for example boron (B), aluminum (Al), gallium (Ga), carbon (C), germanium (Ge), N or phosphorus (P); and $A_3$ is a 1−, 2− or 3− anion such as for example F, Cl, bromine (Br), N or S. The formula is written to indicate that the $A_1$ cation replaces Sr; the $A_2$ cation replaces Si and the $A_3$ anion replaces O. The value of x is an integer or non-integer between 2.5 and 3.5.

US2006/028122 discloses a silicate-based yellow-green phosphor having a formula $A_2SiO_4:Eu^{2+}D$, where A is at least one of a divalent metal comprising Sr, Ca, Ba, Mg, Zn or cadmium (Cd); and D is a dopant comprising F, Cl, Br, iodine (I), P, S and N. The dopant D can be present in the phosphor in an amount ranging from about 0.01 to 20 mole percent. The phosphor can comprise $(Sr_{1-x-y}Ba_xM_y)SiO_4:Eu^{2+}F$ in which M comprises Ca, Mg, Zn or Cd.

US2006/261309 teaches a two phase silicate-based phosphor having a first phase with a crystal structure substantially the same as that of $(M1)_2SiO_4$; and a second phase with a crystal structure substantially the same as that of $(M2)_3SiO_5$ in which M1 and M2 each comprise Sr, Ba, Mg, Ca or Zn. At least one phase is activated with divalent europium ($Eu^{2+}$) and at least one of the phases contains a dopant D comprising F, Cl, Br, S or N. It is believed that at least some of the dopant atoms are located on oxygen atom lattice sites of the host silicate crystal.

US2007/029526 discloses a silicate-based orange phosphor having the formula $(Sr_{1-x}M_x)_yEu_zSiO_5$ in which M is at least one of a divalent metal comprising Ba, Mg, Ca or Zn; $0<x<0.5$; $2.6<y<3.3$; and $0.001<z<0.5$. The phosphor is configured to emit visible light having a peak emission wavelength greater than about 565 nm.

The phosphor can also comprise an aluminate-based material such as is taught in our co-pending patent applications US2006/0158090 and US2006/0027786 the content of each of which is hereby incorporated by way of reference thereto.

US2006/0158090 teaches an aluminate-based green phosphor of formula $M_{1-x}Eu_xAl_yO_{[1+3y/2]}$ in which M is at least one of a divalent metal comprising Ba, Sr, Ca, Mg, Mn, Zn, Cu, Cd, Sm and thulium (Tm) and in which $0.1<x<0.9$ and $0.5\leq y\leq 12$.

US2006/0027786 discloses an aluminate-based phosphor having the formula $(M_{1-x}Eu_x)_{2-z}Mg_zAl_yO_{[1+3y/2]}$ in which M is at least one of a divalent metal of Ba or Sr. In one composition the phosphor is configured to absorb radiation in a wavelength ranging from about 280 nm to 420 nm, and to emit visible light having a wavelength ranging from about 420 nm to 560 nm and $0.05<x<0.5$ or $0.2<x<0.5$; $3\leq y\leq 12$ and $0.8\leq z\leq 1.2$. The phosphor can be further doped with a halogen dopant H such as Cl, Br or I and be of general composition $(M_{1-x}Eu_x)_{2-z}Mg_zAl_yO_{[1+3y/2]}:H$.

It will be appreciated that the phosphor is not limited to the examples described herein and can comprise any inorganic phosphor material including for example nitride and sulfate phosphor materials, oxy-nitrides and oxy-sulfate phosphors or garnet materials (YAG).

Figure 4:
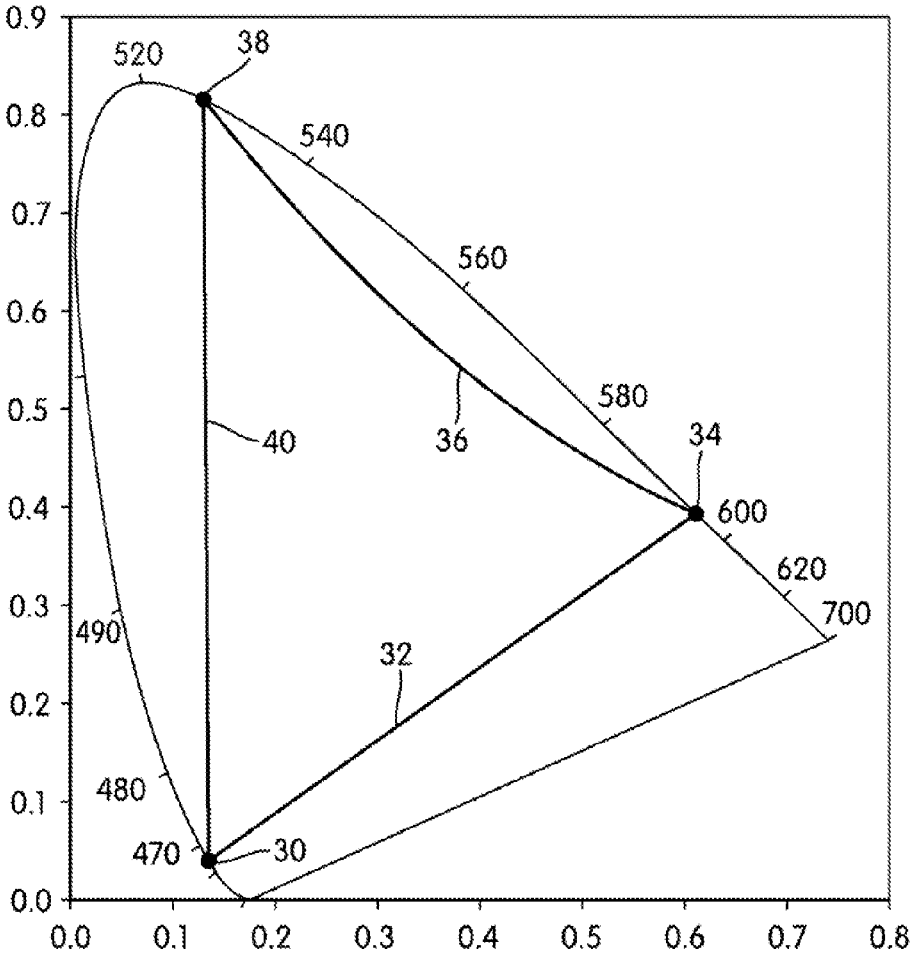
FIG. 4 is a CIE 1931 chromaticity diagram illustrating color tuning for the light source of FIG. 3.

FIGS. 3(*a*) to (*f*) are schematic representations of the operation of a color tunable light emitting device in accordance with a further embodiment of the invention. Throughout this specification like components are denoted using like reference numerals. In the embodiment of FIG. 3 the wavelength converting component 16 comprises two overlapping tapered parts 16*a* and 16*b* that respectively include red (R) and green (G) light emitting phosphor materials. FIG. 4 is a CIE (Commission Internationale de l'Eclairage) 1931 chromaticity diagram illustrating color tuning for the device of FIG. 3.

In FIG. 3(*a*) the wavelength converting component 16 is shown in a fully retracted position such that light 22 generated by the device 10 comprises light from the LED chip only. Consequently light generated by the device is blue (B) in color, and corresponds to point 30 in FIG. 4.

In FIG. 3(*b*) the wavelength converting component 16 has been translated in a direction 18 such that light 14 from the LED is now incident on the red light generating part 16*a* of the component. Now the red light emitting phosphor material within the component will absorb a part of the excitation radiation and re-emit red light. Consequently, the light 22 generated by the devices comprises a combination of blue and red light and will appear warm white (WW) to indigo in color depending on the relative proportions of blue and red light. The proportion of red light in the output light depends on the concentration of phosphor per unit area which will depend on the position of the component relative to the LED.

In FIG. 3(*c*) the wavelength converting component 16 has been further translated such that the thickest portion of the component part 16*a* is now positioned over the LED chip. The concentration of phosphor within and thickness of the part 16*a* are selected such the red light generating phosphor now absorbs all the blue light from the LED and re-emits red light. Thus the light 22 generated by device now comprises red light generated by the phosphor only and this is indicated as point 34 on the chromaticity diagram of FIG. 4. It will be appreciated that the color of light emitted by the device is tunable between the points 30 and 34 along a line 32 and depends on the position of the wavelength selective component.

In FIG. 3(*d*) the wavelength converting component 16 has been further translated in a direction 18 such that light 14 from the LED is now incident on a region of the component that comprises both red and green light generating parts 16*a* and 16*b*. As illustrated, the component is positioned such that the thickness of the green light generating part 16*b* is greater than that of the red light generating part 16*a* and hence the proportion of green light is correspondingly greater. Now the red and green light emitting phosphor materials within the component parts 16*a* and 16*b* will between them absorb substantially all of the excitation radiation and respectively re-emit red and green light. Consequently, the light 22 generated by the device comprises a combination of red and green light and will appear yellow/green in color. The relative proportions of red and green light in the output light depend on the relative densities of phosphor per unit area which will depend on the position of the component relative to the LED.

In FIG. 3(*e*) the wavelength converting component 16 has been further translated such that the thickest portion of the component part 16*b* is now positioned over the LED chip. At this point the part 16*a* makes no contribution to the emitted light. The concentration of phosphor within and thickness of the part 16*b* are selected such the green light generating phosphor now absorbs all light from the LED and re-emits green light. Thus the light 22 generated by device now comprises green light generated by the phosphor only and this indicated as point 38 on the chromaticity diagram of FIG. 4. It will be appreciated that the color of light emitted by the device is tunable between the points 34 and 38 along a line 36 and depends on the position of the wavelength selective component.

In FIG. 3(*f*) the wavelength converting component 16 has been further translated such that a relatively thinner portion of the component part 16*b* is now positioned over the LED chip. Now the green light emitting phosphor material within the component will absorb a part of the excitation radiation and re-emit green light. Consequently, the light 22 generated by the device comprises a combination of blue and green light and will appear turquoise in color. The proportion of green light in the output light depends on the concentration of phosphor per unit area which will depend on the position of the component relative to the LED. It will be appreciated that the color of light emitted by the source is tunable between the points 38 and 30 along a line 40 and depends on the position of the wavelength selective component.

Figure 5:
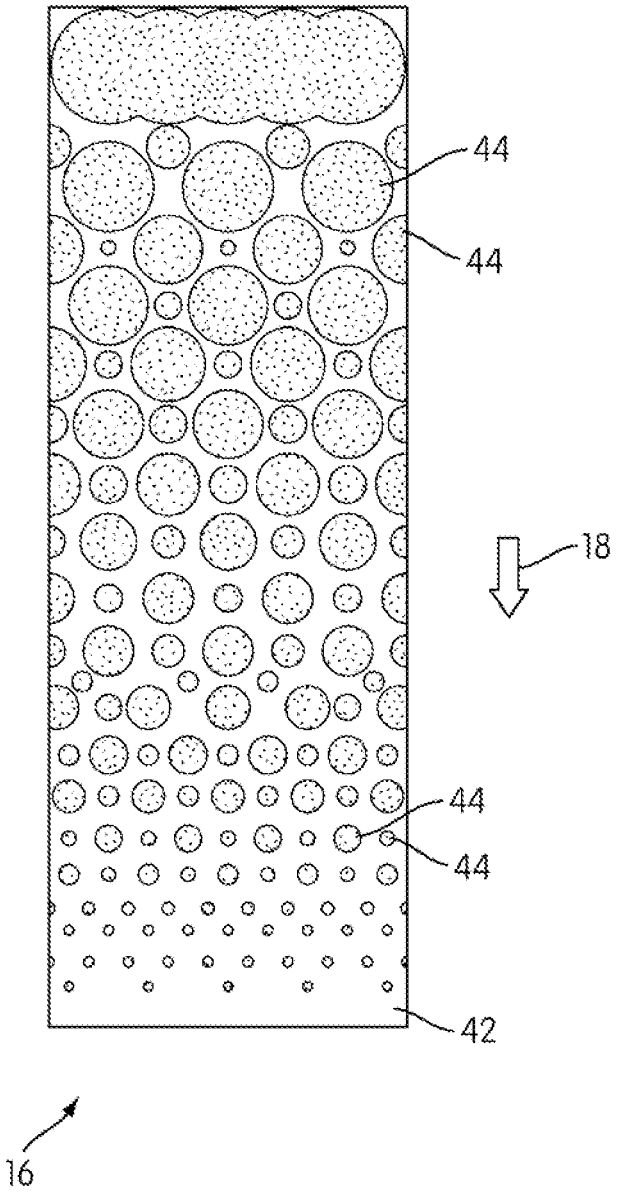
FIG. 5 is a schematic representation of a wavelength converting component in accordance with the invention.
Figure 6A:
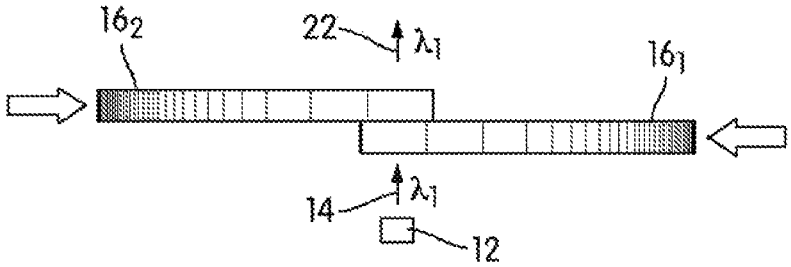
FIGS. 6(*a*) to (*d*) are schematic representations of the operation of a color tunable light emitting device in accordance with a further embodiment of the invention.
Figure 6B:
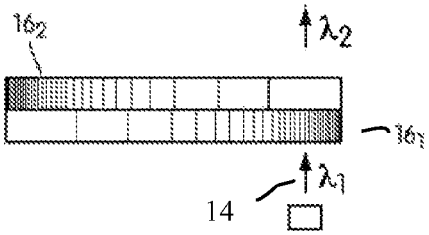
Figure 6C:
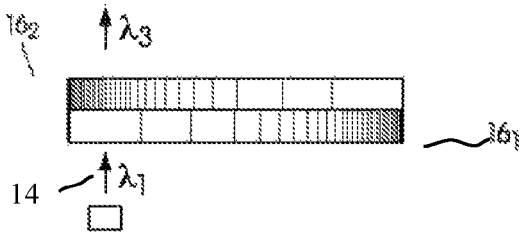
Figure 6D:
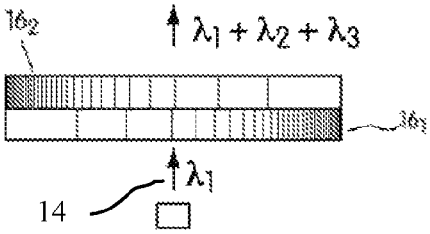

The wavelength converting component has been described as having a tapering thickness such that the concentration of phosphor per unit area varies spatially as a function of position on the component. FIG. 5 is a schematic representation of a wavelength converting component 16 in accordance with an alternative implementation. In this implementation the wavelength converting component comprises a transparent carrier 42 of substrate material having on a surface a pattern of phosphor material. The phosphor pattern can be provided on the carrier by depositing the phosphor material using screen printing, ink jet printing or other deposition techniques. In the example illustrated the phosphor pattern comprises a pattern of circular dots 44 of phosphor material. The relative size and/or spacing of the dots 42 is selected such that the phosphor concentration per unit area varies along the intended direction 18 of movement of the component. The dots 42 can also be provided as an array of equally spaced non-overlapping areas (dots) of varying size using a halftone system. The wavelength converting component of FIG. 3 can be fabricated by a pattern of two or more phosphor materials. Moreover, it will be appreciated that any pattern of phosphor material can be used provided the phosphor concentration per unit area changes spatially with position on the surface of the component. For example, the pattern can comprise a pattern of lines of varying width and/or spacing. Alternatively, or in addition the concentration of the phosphor material (that is loading of phosphor to binder material) within different parts of the pattern can be used to achieve a spatially varying phosphor pattern. An advantage of such a component is ease of fabrication and being of substantially uniform thickness enables the component to be moveably mounted within a simple guide arrangement.

FIGS. 6(*a*) to (*d*) are schematic representations of the operation of a color tunable light emitting device in accordance with a further embodiment of the invention which includes two independently moveably wavelength converting components $\mathbf{16}_1$ and $\mathbf{16}_2$. In this embodiment each wavelength converting component $\mathbf{16}_1$ and $\mathbf{16}_2$ is fabricated in accordance with the implementation of FIG. 5 and includes a pattern of phosphor material which respectively generates light of wavelength $\lambda_2$ (red) and $\lambda_3$ (green). The phosphor pattern is represented in FIG. 6 as a series of lines passing through the thickness of the component whose change of spacing represents the change in concentration of the phosphor material.

In FIG. 6(*a*) both wavelength converting components $\mathbf{16}_1$ and $\mathbf{16}_2$ are shown in a retracted position such that light 14, excitation radiation, from the LED is incident on an end portion of each component which contains a very low concentration per unit area of phosphor material, or no phosphor material. Consequently light 22 generated by the device 10 comprises the light 14 from the LED chip 12 only and is blue in color (wavelength $\lambda_1$). This corresponds to point 46 in the CIE diagram of FIG. 7.

In FIG. 6(*b*) the wavelength converting component $\mathbf{16}_1$ has been translated such that light 14 from the LED is now incident on the opposite end portion of the component $\mathbf{16}_1$ which contains the highest concentration of phosphor material. The position of the component $\mathbf{16}_2$ remains unchanged. Now, the red light emitting phosphor material within the component $\mathbf{16}_1$ will absorb all of the excitation radiation and re-emit red light ($\lambda_2$). This corresponds to point 48 of the chromaticity diagram of FIG. 7. The color of light emitted by the device can be tuned along a line connecting points 46 and 48 by moving the component $\mathbf{16}_1$ such that the excitation radiation is incident on intermediate portions of the component having a differing concentration of phosphor per unit area whilst keeping the component $\mathbf{16}_2$.

In FIG. 6(*c*), which is the converse of situation in FIG. 6(*b*), the wavelength converting component $\mathbf{16}_2$ has been translated such that light 14 from the LED is incident on the end portion of the component which contains the highest concentration of phosphor material. The first component $\mathbf{16}_1$ is in a retracted position such that light from the LED is incident on the end portion of this component containing no of phosphor material. With the components in these positions the green light emitting phosphor material within the component $\mathbf{16}_2$ will absorb all of the excitation radiation and re-emit green light ($\lambda_3$). This corresponds to point 50 of the chromaticity diagram of FIG. 7. It will be appreciated that the color of light emitted by the device can be tuned along a line connecting points 46 and 50 by moving the component $\mathbf{16}_2$ such that the excitation radiation is incident on intermediate portions of the component having a differing concentration of phosphor per unit area.

In FIG. 6(*d*) the wavelength converting components $\mathbf{16}_1$ and $\mathbf{16}_2$ are position such that light 14 from the LED is incident on the portion of the components approximately midway between the ends, that the portion of each component having an intermediate concentration of phosphor material. Now, the red and green light emitting phosphor materials within the components $\mathbf{16}_1$ and $\mathbf{16}_2$ will between them absorb a substantial proportion of the excitation radiation and re-emit a combination of red light ($\lambda_2$) and green light ($\lambda_3$). This corresponds to a point along a line connecting the points 48 and 50 of the chromaticity diagram of FIG. 7.

Figure 7:
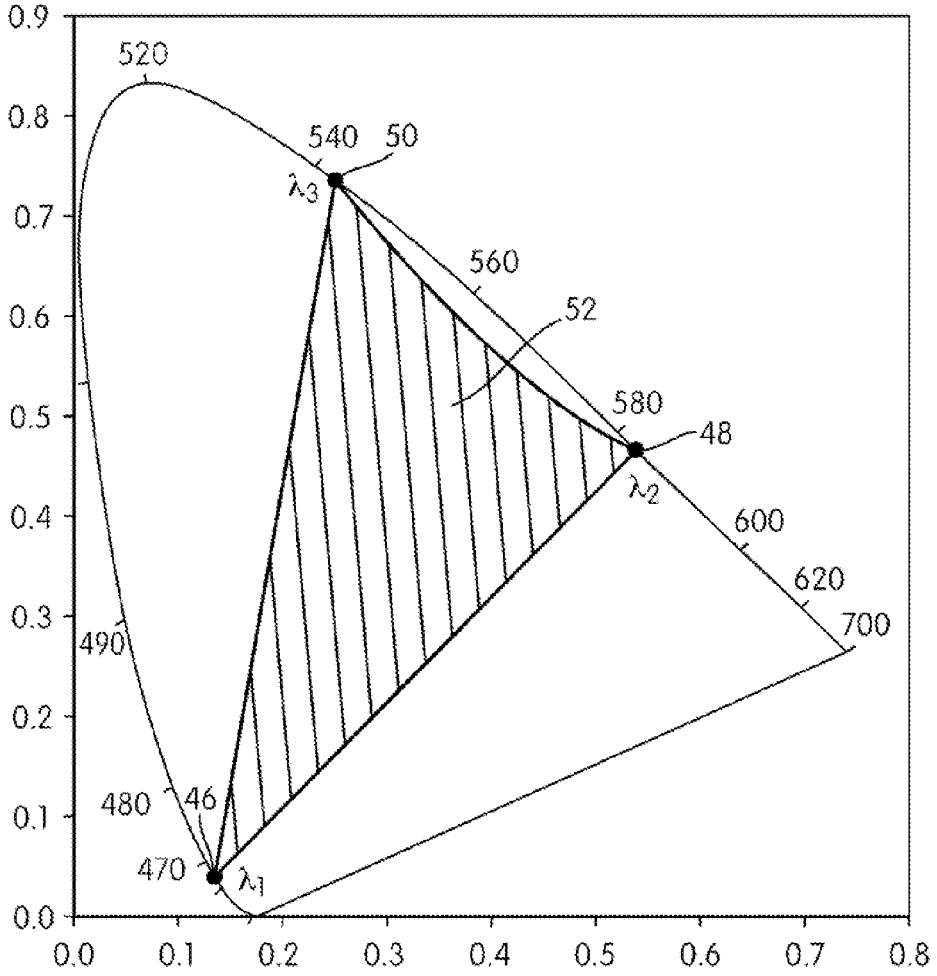
FIG. 7 is a CIE 1931 chromaticity diagram illustrating color tuning for the light source of FIG. 6.

An advantage of using two different independently controllable wavelength converting components is that the color of generated light 22 is tunable within a color space as is indicated by the cross hatched region 52 of the chromaticity diagram of FIG. 7.

Figure 8A:
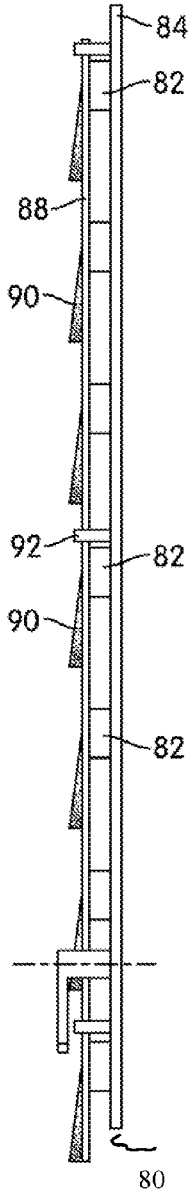
FIGS. 8(*a*) to (*c*) are representations of a color temperature tunable white light emitting lighting bar in accordance with the invention.
Figure 8B:
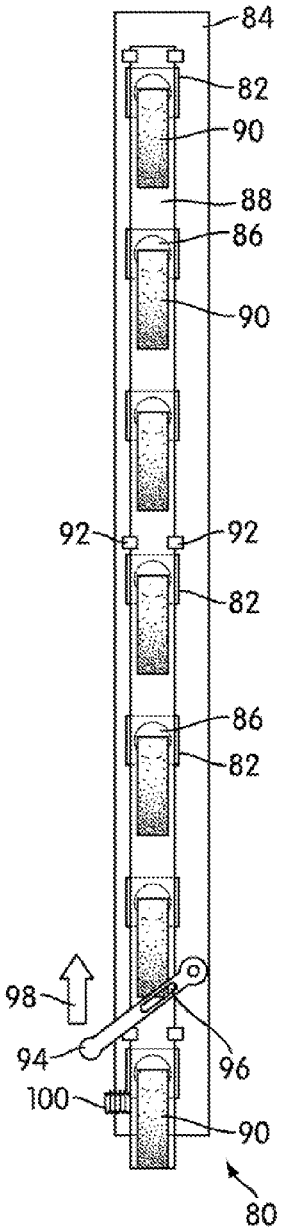
Figure 8C:
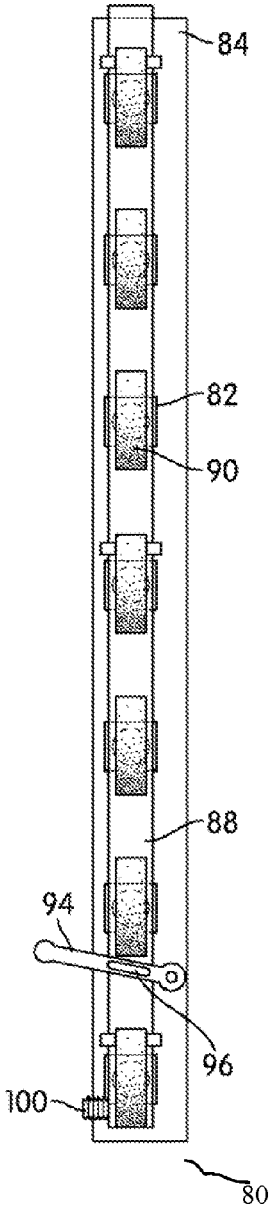

FIGS. 8(*a*) to (*c*) show a color temperature tunable white light emitting bar 80 in accordance with the invention. The light bar 80 is intended for use in lighting applications and is capable of generating white light whose correlated color temperature (CCT) is tunable and can be set by a manufacturer and/or user between cool white (CW) of CCT≈17000K and warm white (WW) of CCT≈3000K. FIGS. 8(*a*) and (*b*) respectively show edge and plan views of the lighting bar 80 and FIG. 8(*c*) a further plan view in which the lighting bar has been tuned to a different CCT.

The lighting bar 80 comprises seven LEDs 82 that are mounted as a linear array along the length of a bar 84. The bar 84 provides both electrical power to each LED and thermal management of the LEDs and can be mounted to a suitable heat sink (not shown). Each LED 82 comprises an InGaN/GaN (indium gallium nitride/gallium nitride) based LED chip which is packaged in a square housing and includes one or more phosphor materials such that each is operable to generate cold white (CW) light. Typically, the phosphor material can comprise a green-silicate based phosphor material. The area of light emission of each LED is indicated by a circle 86.

The lighting bar 80 further comprises a wavelength converting component in the form of a transparent carrier bar 88 made of a transparent material, such as acrylic, that includes seven wavelength converting regions 90 along its length. The wavelength converting regions 90 have substantially identical wavelength converting characteristics that vary in a direction along the length of the carrier with a respective region 90 corresponding to a respective one of the LEDs 82. Each wavelength converting region can comprises a yellow-silicate based light emitting phosphor material whose concentration per unit area varies substantially linearly along its length. As with the lighting devices described above, the change of concentration can be implemented by incorporating the phosphor material with a transparent binder and varying the thickness of each region along its length as illustrated or by depositing the phosphor material in the form of a pattern whose concentration varies spatially. The carrier bar 88 is movable mounted to the bar 84 by pairs of guides 92 with an underside of the carrier 88 in sliding contact with the LEDs. A thumb lever 94 is pivotally mounted to the bar 84 and a slot in the lever is coupled to stud 96 extending from the upper surface of the carrier 88. Movement of the lever in a direction 98 causes a translation of the carrier relative the LEDs. A locking screw 100 is provided to lock the position of the carrier in relation to bar 88.

In operation, a manufacturer or installer can set the lighting bar 80 to a selected color temperature by loosening the locking screw 100 and operating the lever 94 until the lighting bar generates the required color temperature of output light. It will be appreciated that operation of the lever causes a translation of the carrier and the wavelength converting regions 90 relative to the bar and their respective LED (FIG. 8(*c*)). This results in the proportion of light (yellow) in the output generated by the wavelength converting regions to change and hence the color temperature of the output to change. Once the selected color temperature is set the locking screw is tightened to lock the carrier in position. A particular benefit of the lighting bar is that since its color temperature can be tuned post-production this eliminates the need for expensive binning. As well as the manufacturer or installer setting the color temperature a user can periodically adjust the color temperature of the bar throughout the lifetime of the device.

In alternative arrangements where it is required to adjust the color temperature more frequently, such as for example "mood" lighting, the carrier can be moved automatically using a motor or actuator such as a piezoelectric or magnetostrictive actuator. Although the LEDs are illustrated as being equally spaced it will be appreciated that they can be unequally spaced provided the spacing of the wavelength converting regions corresponds to the LEDs.

Figure 9:
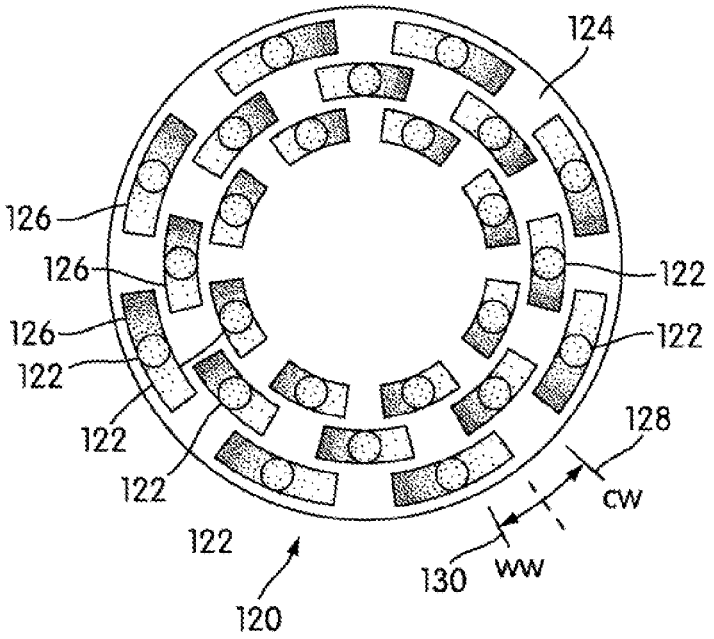
FIG. 9 is a schematic representation of a color temperature tunable white light emitting device in accordance with a further embodiment of the invention in which the wavelength converting component is rotatable.

FIG. 9 is a schematic representation of a color temperature tunable white light emitting device 120 in accordance with a further embodiment of the invention in which the wavelength converting component is rotatable. The white light emitting device 120 is capable of generating white light whose CCT is tunable between cool white (CW) and warm white (WW). In this implementation the device comprises a circular array of twenty four LEDs 122 arranged around three concentric circles. The wavelength converting component comprises a rotatable transparent disc 124 having a corresponding array of twenty four wavelength converting regions 126 on its upper surface. Each wavelength converting region 126 has a wavelength converting property that varies in a substantially identical way for a given angular rotation in a given sense of rotation. As a result the wavelength converting regions nearer to the axis of rotation are shorter in length than those located nearer the periphery of the disc 124. In FIG. 9 the wavelength converting component is illustrated as being in a position such that a central portion of each wavelength converting region 126 overlies it associated LED 122. It will be appreciated that color temperature of light emitted by the device can be tuned between CW and WW by rotation of the disc 124 between positions 128 and 130.

Figure 10:
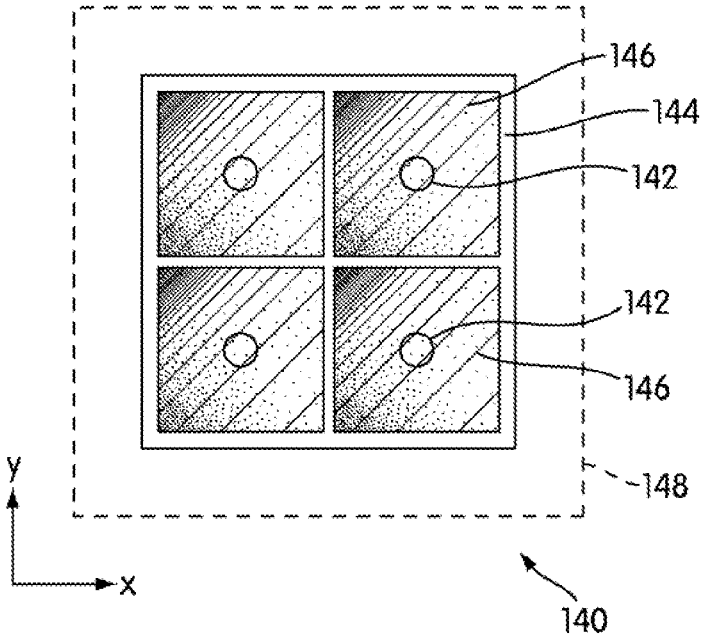
FIG. 10 is a schematic representation of a color tunable light emitting device in accordance with a further embodiment of the invention in which the wavelength converting component is movable in two directions.

FIG. 10 is a schematic representation of a color tunable light emitting device 140 in accordance with a yet further embodiment of the invention in which the wavelength converting component is movable (translatable) in two directions x, y. In this embodiment four LEDs 142 are arranged in the form of a square array and the wavelength converting component comprises a transparent square plate 144 which is movable in two directions corresponding the axes x and y. A corresponding square array of four square wavelength converting regions 146 is provided on the transparent plate 144. In this example each wavelength converting region 146 includes two different phosphor materials, represented by lines and dots respectively, each of which whose concentration per unit area varies over the wavelength converting region. The wavelength converting properties of each wavelength converting region vary in a substantially identical way in the directions of x and y. In FIG. 10 the wavelength converting component is illustrated as being in a position such that a central portion of each wavelength converting region 146 overlies it associated LED 142. The color of light generated by the device can be tuned by translation of the plate in the directions x and y. The range of movement of the plate 144 is indicated by a dashed line 148.

A particular benefit of the light emitting devices in accordance with the invention is that they can eliminate the need for binning. A further advantage is cost reduction compared with multi-colored LED packages and their associated complex control systems.

It will be further appreciated that the present invention is not restricted to the specific embodiments described and that variations can be made that are within the scope of the invention. For example the number and arrangements of LEDs and/or configuration of the wavelength converting component can be adapted for a given application.

What is claimed is:

1. A color tunable light emitting device comprising: an excitation source operable to generate light of a first wavelength range and a wavelength converting component comprising at least one phosphor material which is operable to convert at least a part of the light into light of a second wavelength range, wherein light emitted by the device comprises combined light of the first and second wavelength ranges, wherein the wavelength converting component has a wavelength converting property that varies spatially and wherein color of light generated by the source is tunable by a relative movement of the wavelength converting component and excitation source such that the light of the first wavelength range is incident on a different part of the wavelength converting component, and further comprising a second wavelength converting component comprising a second phosphor material which is operable to convert at least a part of the light of the first wavelength range into light of a third wavelength range, wherein light emitted by the device comprises the combined light of the first, second and third wavelength ranges wherein the second wavelength converting component has a wavelength converting property corresponding to a concentration of the at least one phosphor material per unit area that varies spatially and wherein color of light generated by the source is tunable by moving the first and second wavelength converting components relative to the excitation source such that the light of the first wavelength range is incident on different parts of the first and second wavelength converting components.

2. The device according to claim 1, wherein a thickness of the at least one phosphor material varies spatially.

3. The device according to claim 2, wherein the thickness varies substantially linearly.

4. The device according to claim 1, wherein the at least one phosphor is incorporated in a transparent material with the concentration of the at least one phosphor material per unit volume of transparent material that is substantially constant and wherein a thickness of the wavelength converting component varies spatially.

5. The device according to claim 1, wherein the wavelength converting component comprises a transparent carrier on a surface of which the at least one phosphor material is provided.

6. The device according to claim 5, wherein the at least one phosphor is provided as a spatially varying pattern.

7. The device according to claim 1, wherein the wavelength converting component further comprises a second phosphor material which is operable to convert at least a part of the light of the first wavelength range into light of a third wavelength range, wherein light emitted by the device comprises the combined light of the first, second and third wavelength ranges and wherein a concentration per unit area of the second phosphor material varies spatially.

8. The device according to claim 1, wherein the wavelength converting component is moveable relative to the excitation source and has a wavelength converting property that varies and is selected from the group consisting of varying: along a single dimension; along two dimensions; and rotationally.

9. The device according to claim 1, wherein the first and second wavelength converting components are independently moveable with respect to one another and to the excitation source.

10. The device according to claim 1, wherein a thickness of the second phosphor material varies spatially.

11. The device according to claim 10, wherein the thickness varies substantially linearly.

12. The device according to claim 1, wherein the second phosphor is incorporated in a transparent material with a concentration of the second phosphor material per unit volume of transparent material that is substantially constant and wherein a thickness of the wavelength converting component varies spatially.

13. The device according to claim 1, wherein the second wavelength converting component comprises a transparent carrier on a surface of which the second phosphor material is provided.

14. The device according to claim 13, wherein the second phosphor material is provided as a pattern that varies spatially.

15. The device according to claim 9, wherein the excitation source comprises a light emitting diode.

16. A color tunable light emitting device comprising: a plurality of light emitting diodes operable to generate light of a first wavelength and a wavelength converting component which is operable to convert at least a part of excitation radiation into light of a second wavelength, wherein light emitted by the device comprises combined light of first and second wavelength ranges and wherein the wavelength converting component comprises a plurality of wavelength converting regions comprising at least one phosphor material in which a respective region is associated with a respective one of the light emitting diode and wherein each region has a wavelength converting property corresponding to a concentration of the at least one phosphor material per unit area that varies spatially and wherein color of light generated by the device is tunable by moving the component relative to the light emitting diodes such that the light of the first wavelength range from each light emitting diode is incident on a different part of its respective wavelength converting region, wherein the plurality of light emitting diodes comprise a linear array and the wavelength converting regions comprise a corresponding linear array and wherein the color tunable light emitting device is tunable by linearly displacing the component relative to the linear array of light emitting diodes.

17. The device according to claim 16, wherein the plurality of light emitting diodes comprise a two dimensional array and the wavelength converting regions comprise a corresponding two dimensional array and wherein the source is tunable by displacing the component relative to the array of light emitting diodes along two dimensions.

18. The device according to claim 16, wherein the plurality of light emitting diodes comprise a circular array and the wavelength converting regions comprise a corresponding circular array and wherein the device is tunable by rotationally displacing the component relative to array of light emitting diodes.

* * * * *